US006428238B2

(12) United States Patent
Hedgewick

(10) Patent No.: US 6,428,238 B2
(45) Date of Patent: Aug. 6, 2002

(54) ROAD MARKER COLLAR

(75) Inventor: Peter Hedgewick, Windsor (CA)

(73) Assignee: Pac-Tec, Inc., Heath, OH (US)

( * ) Notice: Subject to any disclaimer, the term of this patent is extended or adjusted under 35 U.S.C. 154(b) by 0 days.

(21) Appl. No.: 09/780,157

(22) Filed: Feb. 9, 2001

Related U.S. Application Data

(63) Continuation-in-part of application No. 08/948,948, filed on Oct. 10, 1997, now Pat. No. 6,200,064
(60) Provisional application No. 60/028,302, filed on Oct. 11, 1996.

(51) Int. Cl.[7] ..... E01F 11/00
(52) U.S. Cl. ..... 404/16; 404/15
(58) Field of Search ..... 404/15, 16; D10/113; 116/63 R

(56) References Cited

U.S. PATENT DOCUMENTS

| | | | | | |
|---|---|---|---|---|---|
| 3,758,191 | A | * | 9/1973 | Hedgewick | 359/531 |
| 3,784,279 | A | | 1/1974 | Hedgewick | |
| 4,035,059 | A | | 7/1977 | DeMaster | |
| 4,557,634 | A | | 12/1985 | Walker | |
| 4,577,992 | A | | 3/1986 | Jefferies | |
| 4,618,281 | A | | 10/1986 | Ajemian | |
| 4,717,281 | A | | 1/1988 | Shepherd et al. | |
| 5,354,143 | A | * | 10/1994 | Lindner | 404/9 |
| 5,393,166 | A | * | 2/1995 | Stock et al. | 404/14 |
| 5,425,596 | A | | 6/1995 | Steere et al. | |
| 5,681,128 | A | | 10/1997 | Morgan et al. | |
| 5,816,737 | A | * | 10/1998 | Siblik | 404/13 |
| 5,857,802 | A | | 1/1999 | Richter | |
| 6,116,812 | A | * | 9/2000 | Hedgewick | 404/14 |
| 6,267,530 | B1 | * | 7/2001 | Attar | 404/16 |

FOREIGN PATENT DOCUMENTS

| | | |
|---|---|---|
| FR | 2 401 273 | 8/1979 |

* cited by examiner

*Primary Examiner*—Gary S. Hartmann
(74) *Attorney, Agent, or Firm*—Gifford, Krass, Groh, Sprinkle, Anderson & Citkowski, P.C.

(57) ABSTRACT

A road marker and method of manufacturing a road marker having a base with a large surface area. The base is molded around a potted road reflector to completely seal the bottom and encapsulate the ends of the reflective member. The reflective member has end extensions with notches formed to interlock with the base member.

7 Claims, 3 Drawing Sheets

ROAD MARKER COLLAR

RELATED APPLICATIONS

This application is a continuation-in-part of application Ser. No. 08/948,948, filed Oct. 10, 1997, now U.S. Pat. No. 6,200,064 which takes priority from Provisional Application No. 60/028,302, filed Oct. 11, 1996.

FIELD OF THE INVENTION

This application relates to retro-reflective road markers for installation on the pavement of a road.

BACKGROUND OF THE INVENTION

Road markers having retro-reflective lenses are used on road surfaces to delineate lanes at night. The road markers reflect light from the headlights of an automobile at night to indicate where the lanes of a road are positioned. The markers typically have a trapezoidal cross-section with a rectangular bottom. These markers are approximately two inches wide by four inches long and three-quarters of an inch high. The markers are mounted directly to the road with suitable materials such as bituminous or epoxy.

The markers typically include a molded plastic shell which has cube corner reflective surfaces. These surfaces are formed on the inside of the shell and plated with metal, preferably aluminum. The shells are then filled with a potting material, such as a mixture of epoxy, to provide strength. The potting material provides the marker with strength to withstand the weight of large vehicles such as trucks.

Recently, it has been found that the reflectivity of potted reflectors is decreased over time by transmigration of asphalt chemical tar from the road surface and of the bituminous material used to affix the markers to the road to the metallic coating on the inside of the shell. Thus, it is desirable to provide a marker which is economical, strong and which will resist transmigration.

SUMMARY OF THE INVENTION

The invention relates to a potted road marker and method for making the road marker. The road marker includes a reflective member and a base member which is formed about the end portions and a bottom to encapsulate portions of the reflective member. The reflective member includes a shell having a top and two sides which extend between a pair of ends. At least one of the sides is formed with cube corners which are metallized. The top, sides and ends define a cavity which is filled with a potting material such as epoxy. Each end of the marker has an extended portion which extends longitudinally outwardly. The base member has a lower platform portion having two projections which extend upwardly from the top surface of the base. The projections are spaced apart to receive the reflective member thus between. The projections are wider and slightly higher than the reflective member. The end projections have a curved surface extending from the top to the base so that the projections protect the ends of the reflector. The base is molded about the previously formed reflective member so that the ends of the reflective member are encapsulated in the projections of the base member. In this way, each reflector is securely held to the base and permanently mounted to the base member. Additionally, the base of the reflector member is encapsulated in the base member to prevent transmigration of bituminous or tar chemical into the reflective member.

BRIEF DESCRIPTION OF THE DRAWINGS

The present invention will be more fully understood by reference to the following detailed description when read in conjunction with the accompanying drawings in which the reference characters refer to like parts throughout the several views and in which.

DETAILED DESCRIPTION OF THE PREFERRED EMBODIMENTS

Figure 1:
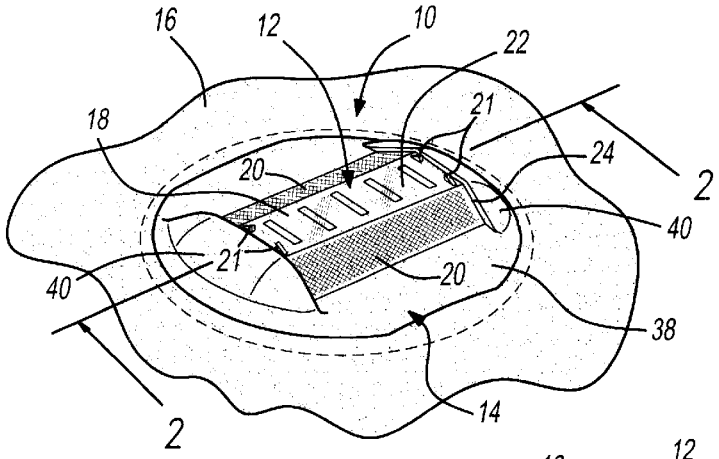
FIG. 1 is a perspective view showing a road marker according to the invention mounted to a road surface.
Figure 2:
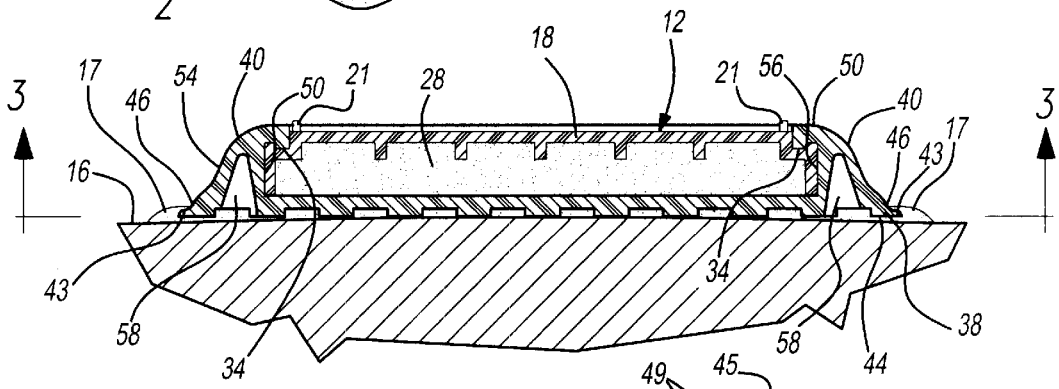
FIG. 2 is a cross-sectional side view of a road marker in accordance with the invention taken along lines 2—2 of FIG. 1.

A road marker in accordance with the invention is shown mounted to a road surface in FIG. 1. As best shown in FIGS. 1 and 2, the road marker 10 includes a reflector member 12 and a base member 14. The road marker 10 is mounted to the road surface 16 with a suitable mounting compound, such as bituminous 17 or hot melt material. The embodiment discussed herein is of the type suitable for use on asphalt surfaces which soften with heat, such as disclosed in U.S. Pat. No. 6,200,064; however, the invention is not limited to this embodiment and may be used with any type product road marker.

As shown in FIGS. 1, 5, 6, and 9, the reflector member 12 includes a shell 18 having two angled sides 20 and a top surface 22 which extends between a pair of trapezoidally shaped ends 24. The shell 18 is formed of a translucent plastic material and may be molded in a single piece or in two halves which are joined together by gluing or ultrasonic welding. The sides 20 have a retro-reflective portion 26 formed in a conventional manner by molding cube corners on the inner surface. It should be noted that the reflector member 12 shown has the retro-reflective portion 26 on each side 20, however, in some cases only one side 20 has the reflective portion 26.

Figure 5:
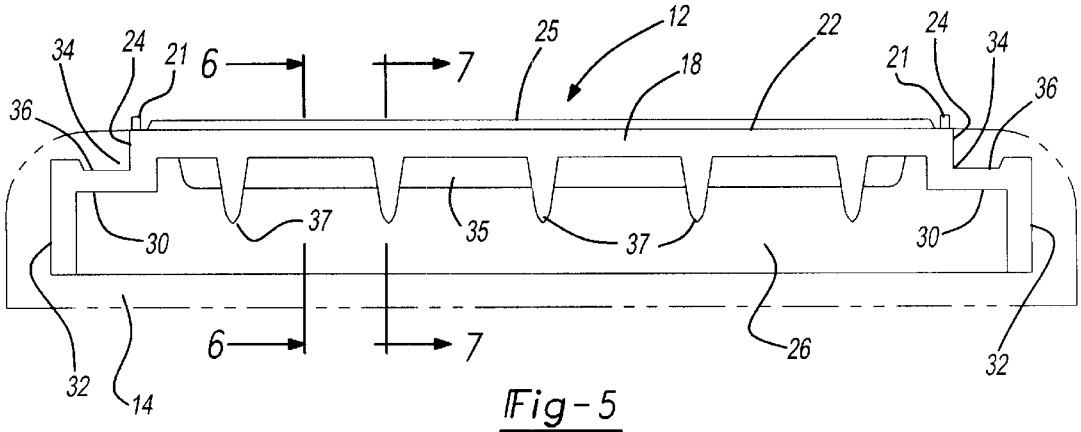
FIG. 5 is a cross-sectional view of a reflective member in accordance with the invention.
Figure 6:
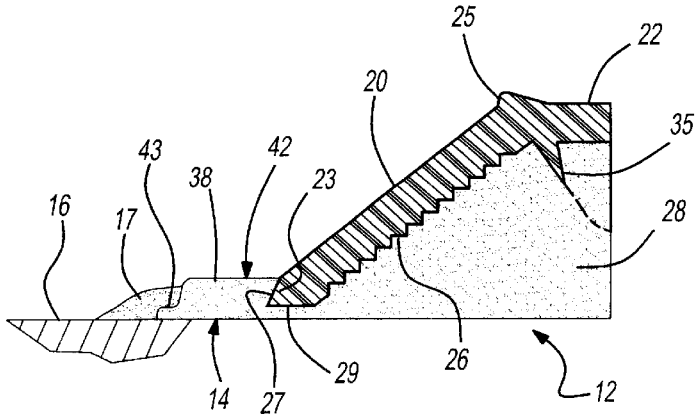
FIG. 6 is a partial cross-sectional side view of the reflective member taken along lines 6—6 of FIG. 5.
Figure 7:
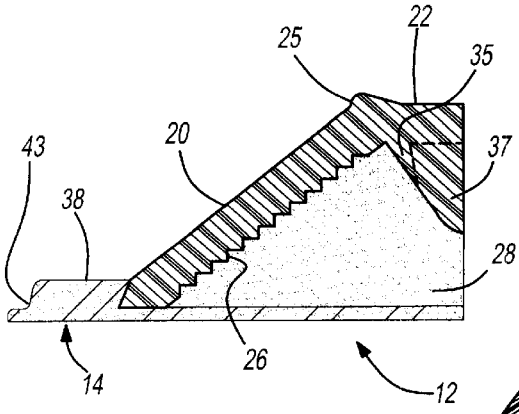
FIG. 7 is a partial cross-sectional side view of the reflective member taken along lines 7—7 of FIG. 5.
Figure 8:
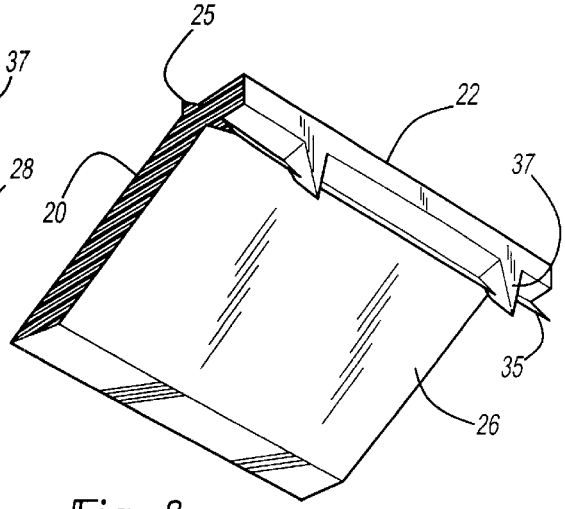
FIG. 8 is a perspective view of a portion of the reflective member showing the ribs and blade for engaging the fill material.

As shown in FIGS. 5–7, a brow 25 or raised lip extends between the ends 24 above the sides 20. The brow 25 protects the sides 20 from abrasion when a tire passes over the reflection marker 12. The brow 25 is particularly useful in preventing the removal of protective coatings as disclosed in U.S. Pat. No. 5,098,217. Two pairs of arms 21 are formed to extend outwardly from the top surface 22 to support the reflective marker during the filling of the potting material as discussed more fully below.

As shown in FIG. 6, the reflector member has a lower portion 23 about which is molded the base member 14. The lower portion has an edge surface 27 which is angled a minimum of 10° from vertical to extend from the side surface 20 away from the center of the marker to a bottom edge 29. The angled edge surface 27 interlocks with the material of the base member 14 to lock the reflector member 12 to the base member 14.

Figure 9:
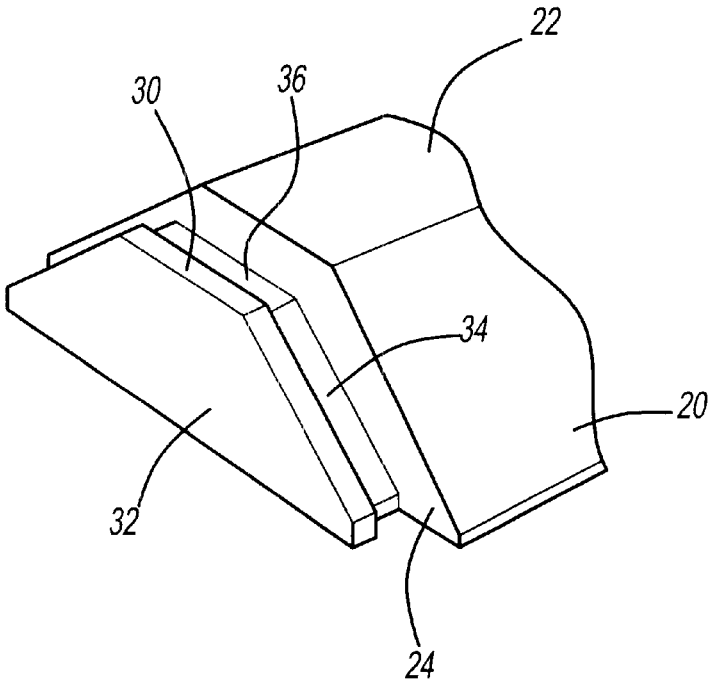
FIG. 9 is a perspective end view of the reflective member before it is encapsulated by the base member.

As best shown in FIGS. 5 and 9, each end 24 of the shell 18 has an extended portion 30 with a trapezoidal wall 32. Each extended portion 30 is formed for encapsulated in the base member 14. To further this purpose, a notch 34 is formed between the wall 32 and end 24. The notch 34 has a bottom surface 36 spaced apart and parallel with the side 20 and a top surface 22. The bottom surface 36 extends approximately 3/16" between the end 24 and wall 32.

As shown in FIGS. 5–8, a longitudinal flange 35 extends from beneath the brow 25 adjacent each side 20 of the reflector member 12. The flanges 35 extend to a point and are angled inwardly towards each other to engage potting material 28 in the cavity. A plurality of ribs 37 are spaced apart to extend transversely below the top into the cavity. Each of the ribs 37 is pointed and extends below each flange to provide strength to the top 22 and engage the potting material 28

The reflector member 12 may be formed as one piece, as shown in FIG. 1, or in two halves, such as shown in FIG. 5. The two halves are glued together, as known in the art. An inner surface of the retro-reflective portion 26 is metallized by vacuum plating. The reflector member 12 is inverted and filled with the potting material 28. The potting material 28 is typically a filled epoxy urethane or other suitable material. The potting material 28 flows into the cavity and surrounds the flanges 35 and ribs 37. After curing, the potting material 28 forms a rigid mass engaging the flanges 35 and ribs 37 to provide strength to the reflector member 12 to withstand the pressure of tires of vehicles passing over the road marker 10.

Figure 3:
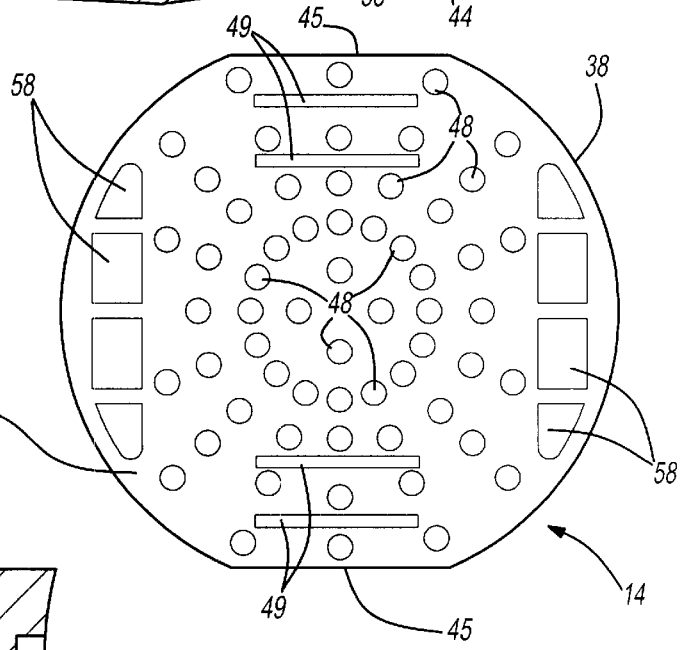
FIG. 3 is a bottom view of the road marker in accordance with the invention.

As shown in FIGS. 1, 2 and 3, the base member 14 has a disc-like lower portion 38 and a pair of diametrically opposed projections 40 extending from the lower portion 38. As shown in FIG. 6, the lower portion has a stepped peripheral edge 46 extending from a bottom surface 44. The edge 46 is stepped to permit the bituminous 17 to ooze over the top of the bottom step 43 to improve the adherence of the marker to the road surface. The step 43 has a height of approximately 1/32" and extends approximately 0.030 inches in a horizontal direction. The edge 46 has opposed edge portions 45 which extend parallel to the sides of the reflector member. The lower portion 38 at the base member is approximately 3/16 inch thick and has a diameter of approximately 5–½ inches. Thus, the surface area of the bottom is more than twice the surface area of a conventional 2"×4" reflector member. The base member 14 may be molded of any suitable material such as ABS.

As shown in FIG. 3, the bottom surface 44 has a plurality of circular perforations 48 formed in a plurality of radially extending lines. The perforations 48 and two pairs of elongated ribs 49 are formed to receive the glue or epoxy for improving adherence of the marker to the road. The elongated ribs are formed to extend parallel with the sides 20 of the road marker so as to prevent dislodgement of the road marker when the tire of a vehicle contacts and passes over the road marker 10.

As shown in FIG. 2, the projections 40 have inner walls 50 which are spaced apart to receive the ends 24 of the reflector therebetween with the notch 34 of the end extension of the reflector member captured by the projection 40 which extends into the notch 34. Each projection 40 has the shape of a quarter sector of an elongated sphere. The projection is set inwardly from the angled edge 46 and has a curved surface 54 which extends upwardly and inwardly from the top surface 42 to the reflector member 12. Each projection has a top portion 56 which is generally flat and slightly above the top surface 22 of the reflector. The projections 40 act to protect the ends 24 of the reflector member from shock and wear as a tire of a vehicle passes over the reflector member. The projections 40 are contoured to facilitate a smooth passage of the tires. Recesses 58 extend from the bottom surface between the walls of the projector from the bottom surface.

In the preferred embodiment, the base member 14 is formed of an ABS material. The ABS material has particularly good shock absorbing characteristics. Other moldable materials such as acrylic may be used.

Figure 10:
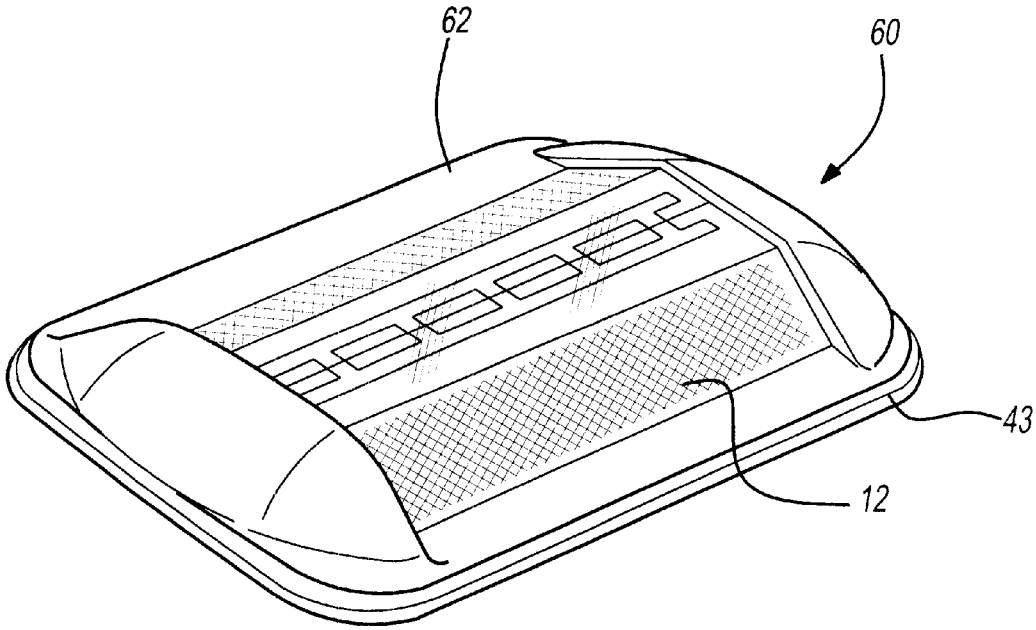
FIG. 10 is an alternative embodiment of a preferred embodiment of the invention.

An alternative preferred embodiment of the invention is shown in FIG. 10. A road marker 60 has a rectangular base member 62. The rectangular base member 62 has a length which extends at least 1" greater than the length of the reflector member 12 and a width "w" which is greater than the width of the shell 18 to at least double the surface area of a bottom surface of the base member compared to the area of the bottom of the reflector member.

Figure 4:
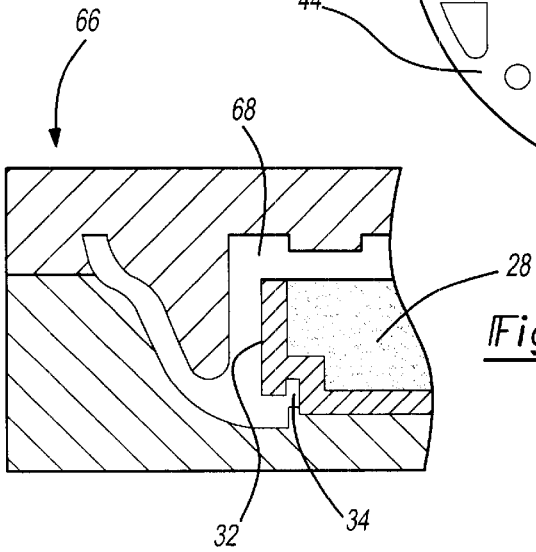
FIG. 4 is a cross-sectional side view of a portion of molds forming the base member about the reflective member.

The road markers 10 and 60 are formed first by molding the shell 18 of the reflective member in a conventional manner. The shell may be formed in a single piece or two complementary pieces which are glued together on their longitudinal edges to form a completed shell 18 with an inner cavity as disclosed above. The shell has at least one retro-reflective portion 26 with "cube corners" integrally molded on the inner surface of the shell. The "cube corners" are metallized by vacuum forming as is known in the art. The marker 10 is then inverted to rest on the arms 23. The cavity is then filled with a potting material, such as epoxy. After the potting material has set, the reflector member is placed within a mold 66 as shown in FIG. 4. The mold 66 has cavities 68 for forming the base member 14 around the reflector member 12. The cavities 68 of the mold 66 are then filled with suitable material, such as epoxy or urethane, and allowed to cure. The arms 21 are then snapped off.

Thus is provided a road marker having a reflective member having a bottom which is sealed against transmigration. The base member has projections which protect the ends of the reflector as well as lock the reflector to the base member. The bottom surface is enlarged with respect to conventional reflectors to prevent depression of the marker into softened road surfaces.

Having described my invention, however, many other modifications thereto may be apparent to those skilled in the art to which it pertains without deviation from the spirit of the invention as defined by the scope of the appended claims.

I claim:

1. A road marker for mounting to a road comprising:

a reflector member having a potting material contained within a shell, said shell having a top and a pair of angled sides extending between a pair of end portions, at least one of said pair of sides having a reflective portion, each of said end portions having a notch, said pair of sides having a bottom edge portion; and a base member having a top surface and a bottom surface adapted to be mounted to a road, a pair of projections extending upwardly from said top surface to receive said reflector member therebetween, said projections having a ridge portion extending into said notch of said reflector member to engage said reflector member.

2. The road marker of claim 1, wherein said notch extends transversely across said top of said reflector member from one side to said another side.

3. The road marker of claim 1, wherein said notch extends across each side from said top to said bottom edge.

4. The road marker of claim 1, wherein said base member has a recess formed between said projections, said bottom edges of said shell being received in said recess.

5. The road marker of claim 1, wherein each of said pair of projections has a width greater than a maximum width of said reflector member.

6. The road marker of claim 1, wherein said projections have a height equal to or slightly greater than a height of said reflector member.

7. The road marker of claim 1, wherein said projections have an outer surface extending outwardly and downwardly from said top to said top surface of said base member.

* * * * *